US005964283A

United States Patent [19]

Pavlin

[11] Patent Number: 5,964,283

[45] Date of Patent: Oct. 12, 1999

[54] HEAT EXCHANGER

[75] Inventor: Jaroslav Pavlin, Freiberg, Germany

[73] Assignee: Filterwerk Mann & Hummel GmbH, Ludwigsburg, Germany

[21] Appl. No.: 08/952,691

[22] PCT Filed: Mar. 22, 1996

[86] PCT No.: PCT/EP96/01252

§ 371 Date: Apr. 9, 1998

§ 102(e) Date: Apr. 9, 1998

[87] PCT Pub. No.: WO96/38699

PCT Pub. Date: Dec. 5, 1996

[30] Foreign Application Priority Data

Jun. 2, 1995 [DE] Germany ..... 195 19 740

[51] Int. Cl.[6] ..... F28F 3/08

[52] U.S. Cl. ..... 165/167; 165/51; 165/906; 165/916; 123/196 AB

[58] Field of Search ..... 165/906, 916, 165/51, 167, 175, 153; 123/196 AB; 184/6.22, 104.3

[56] References Cited

U.S. PATENT DOCUMENTS

| | | | |
|---|---|---|---|
| 4,708,199 | 11/1987 | Yogo et al. | 165/167 |
| 5,146,980 | 9/1992 | Le Gauyer | 165/916 |
| 5,165,468 | 11/1992 | Tajima et al. | 165/916 |
| 5,291,945 | 3/1994 | Blomgren et al. | 165/167 |
| 5,307,869 | 5/1994 | Blomgren | 165/167 |
| 5,492,171 | 2/1996 | Kallrot | 165/167 |
| 5,810,071 | 9/1998 | Pavlin | 165/916 |

FOREIGN PATENT DOCUMENTS

| | | | |
|---|---|---|---|
| 1062529 | 3/1967 | Canada | 165/167 |
| 124-217 | 11/1984 | European Pat. Off. | 165/916 |
| 623798 | 11/1994 | European Pat. Off. | 165/916 |
| 5-1890 | 1/1993 | Japan | 165/916 |
| 2335784 | 1/1974 | United Kingdom | 165/167 |
| 2005-398 | 4/1979 | United Kingdom | 165/167 |
| 2270971 | 3/1994 | United Kingdom | 165/916 |

*Primary Examiner*—Lia S. Lazarus
*Assistant Examiner*—Terrell McKinnon
*Attorney, Agent, or Firm*—Evenson, McKeown, Edwards & Lenahan, P.L.L.C.

[57] ABSTRACT

A heat exchanger, especially an oil cooler for internal combustion engines. The heat exchanger consists of a plurality of mutally parallel tubes to convey the heat exchanging medium and blade-like heat exchange elements arranged perpendicularly to the tubes. The heat exchange elements are firmly secured to the tubes and also bent at the outer edges and are super imposed in the manner of scales. The medium to be cooled is fed via pipes arranged perpendicularly to the heat exchanging elements. The pipes open into a distributor plate having a liquid inlet and a liquid outlet. The inlet and/or outlet for the coolant is also fitted in the diameter of the distributor plate.

6 Claims, 3 Drawing Sheets

Figure 1:
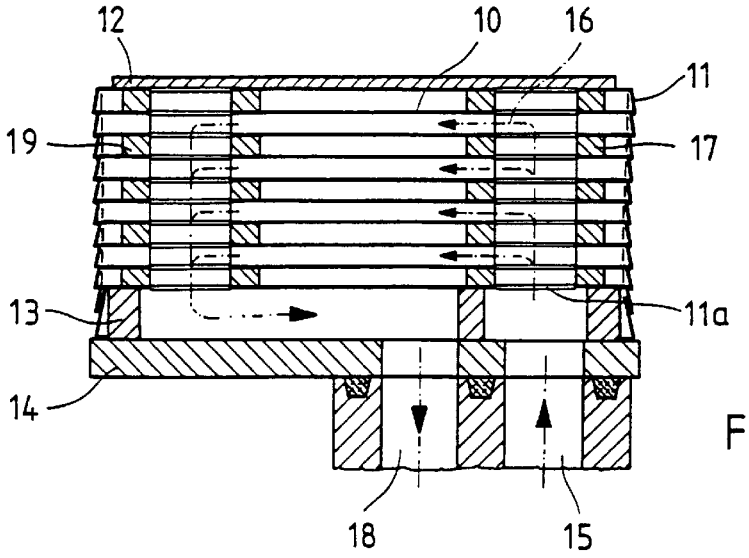

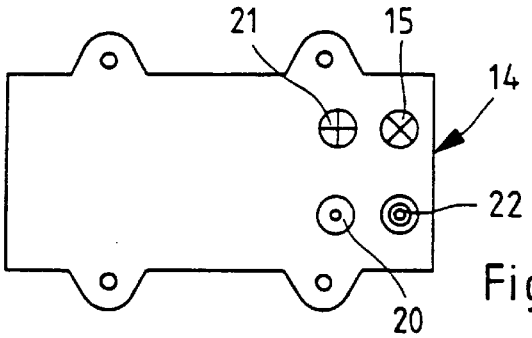
Fig.6a
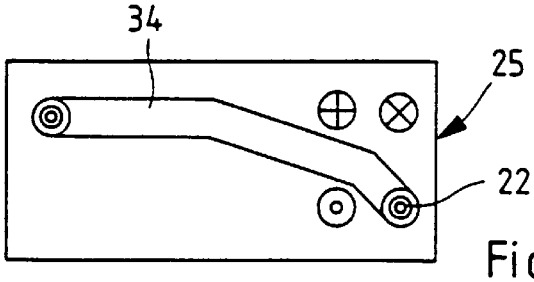
Fig.6b
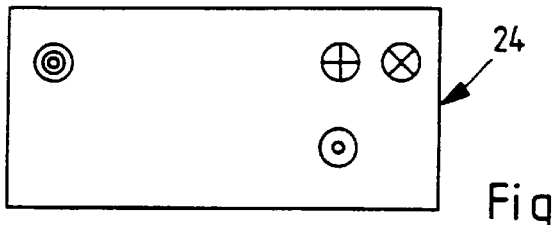
Fig.6c
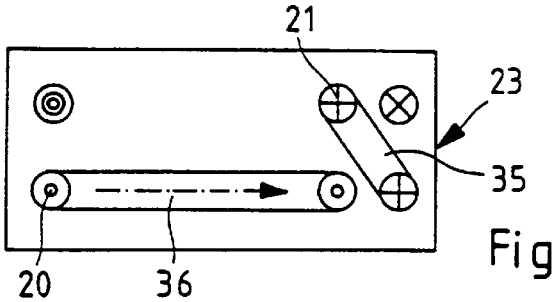
Fig.6d
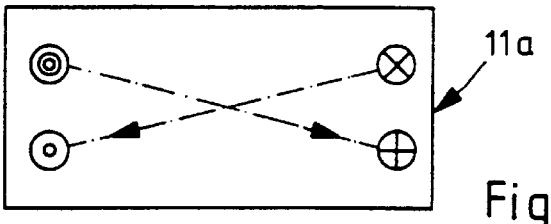
Fig.6e
⊗ = HOT OIL INLET ⊕ = WATER INLET
⊙ = COLD OIL OUTLET ◎ = WATER OUTLET
Fig.6

HEAT EXCHANGER

The invention relates to a heat exchanger, especially an oil cooler for internal combustion engines, according to the preamble of the principal claim.

DE-OS 32 10 114 discloses a heat exchanger, especially a cooler for motor vehicles. This heat exchanger consists of several tubes disposed parallel to one another for carrying the heat exchange fluid. These tubes lead into an upper and a lower water box. The heat exchanger consists furthermore of lamellar plate-like heat exchange ribs disposed perpendicular to the tubes and affixed to the tubes.

These heat exchange ribs are provided at their ends with recurved end portions which are imbricated and thus form side parts on which means for fastening brackets can be disposed. The known heat exchanger, which is constructed with relatively simple elements and has good thermal transfer, has the disadvantage that, to fasten the heat exchanger additional brackets are necessary. Moreover, the connections for the heat exchange fluid are permanently set in the upper and lower water boxes and are not variable.

A heat exchanger is furthermore disclosed in DE-GM 93 09 741 in which on one side of the heat exchanger element an inlet and outlet is provided for the medium being cooled and on the other side an inlet and outlet for the coolant, i.e., the heat exchange fluid. This arrangement is characterized by simplicity of design. In many cases, however, it is desired to arrange all of the inlets and outlets on just one side.

The invention is therefore addressed to the problem of creating a heat exchanger which will be universely usable and, without increasing its bulk, can be connected wherever all of the inlets and outlets are on one side.

Setting out from the preamble of the principal claim, this problem is solved by the distinctive features thereof.

An important advantage of the invention lies in the fact that it is possible by means of the distribution plate also to integrate the inlet and outlet of the coolant. For this purpose the corresponding inlet and outlet openings are provided in the distribution plate.

According to one embodiment of the invention, a fastening plate is provided on the distribution plate. Of course it is also possible to configure the distribution plate and fastening plate as an integral unit. In a preferred manner, in the case of the two-piece configuration the distribution plate and fastening plate are soldered together.

An additional embodiment of the invention provides for constructing the distribution plate of individual plate elements which are sandwiched one on the other. This has the advantage that flow passages of different kinds and with crossovers can be provided in the individual plate elements. Thus it is possible to achieve even complicated courses of flow in the distribution plate.

An additional embodiment of the invention provides for making the individual parts of the heat exchanger from tinned aluminum. This aluminum can be tinned in a continuous oven, so that the assembly of the heat exchanger is possible without connecting.

Advantageously, the distribution plate is also integrated in its sandwich-like construction with the last heat exchanger element. The height of the entire heat exchanger element is not increased by the integration of this plate. At the same time, however, all of the connections are contained in this distribution plate.

In another embodiment of the invention, all of the inlet and outlet lines are integrated in a housing of an oil filter. The heat exchanger can thus be mounted directly on this housing. Additional connecting lines are not necessary. As an alternative, the connections for the coolant are disposed directly on the distribution plate.

These and other features of preferred embodiments of the invention will appear not only in the claims but also in the description and the drawings; the individual features can be realized individually or severally in the form of subcombinations in the embodiment of the invention and in other fields, and may represent advantageous as well as independently patentable embodiments, for which protection is claimed.

Embodiments of the invention are represented in the drawings and are further explained below. The drawings show:

FIG. 1 A schematic view of a heat exchanger, whose side parts are formed by bent ribs.

Figure 2:
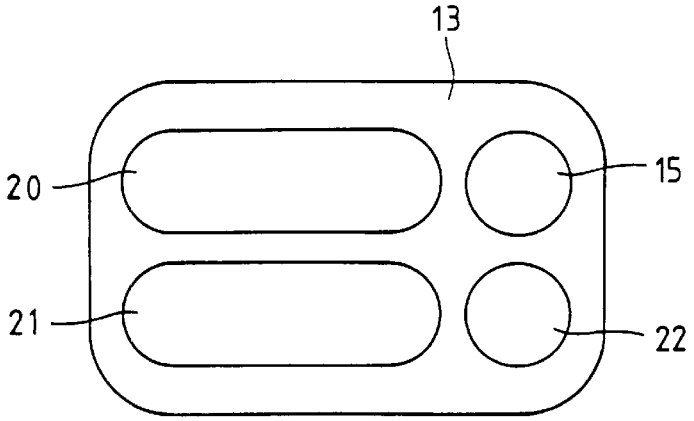

FIG. 2 A top plan view of the distribution plate represented in section in FIG. 1.

Figure 3:
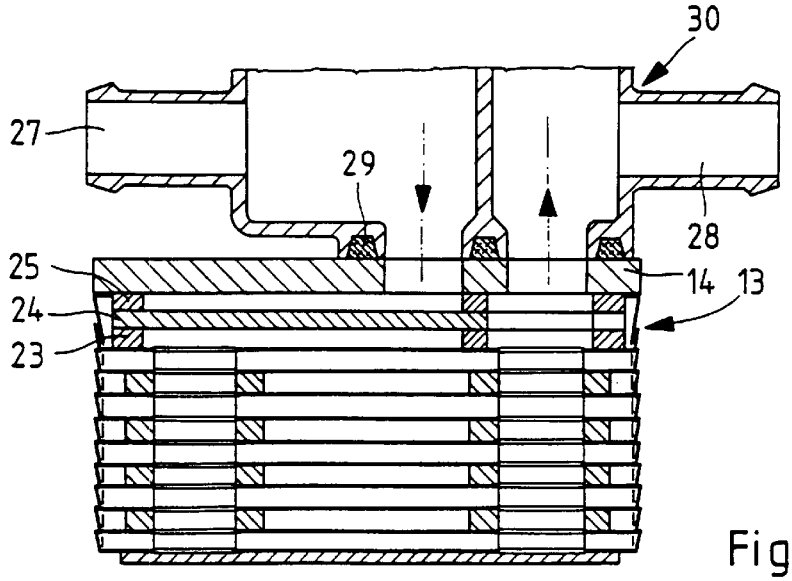

FIG. 3 A heat exchanger with distribution plate, of sandwich construction.

Figure 4:
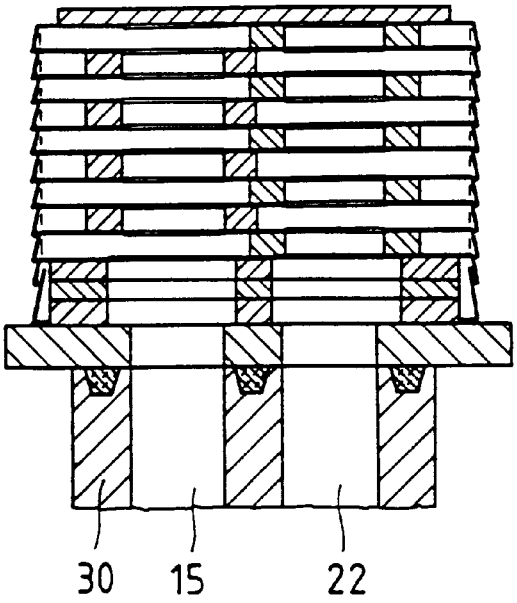

FIG. 4 Another sectional representation.

Figure 5:
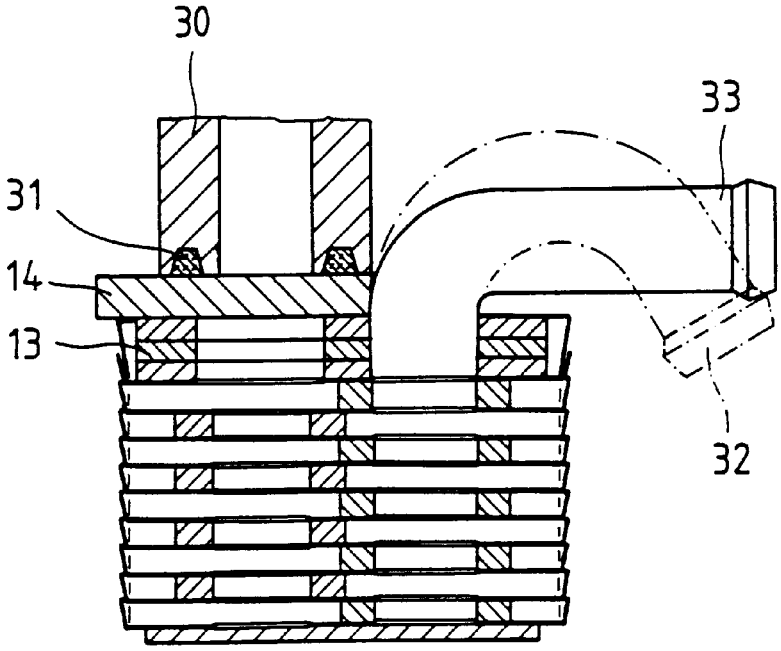

FIG. 5 A sectional representation of a heat exchanger with connections for the coolant.

FIGS. 6*a–e* A flow diagram for the medium to be cooled and the coolant.

In FIG. 1 a heat exchanger is shown which consists of a plurality of plate-like heat exchanger elements 10 arranged parallel to one another, through which a heat exchange medium flows. These heat exchanger elements are rounded at the circumferential outer edges 11 and stacked one on the other to form a heat exchanger pack. A cover plate 12 forms the top of the heat exchanger pack. The bottom is formed by a distribution plate 13 in combination with a mounting plate 14. The distribution plate 13 and mounting plate 14 may also be made in one piece. It is also possible, however, to form it of two stampings. The fastening together of the individual heat exchanger elements 10 and to the cover plate 12 and the distribution plate 13 is performed by soldering. For this purpose the individual components are coated with a solder. The entire packet with the individual parts, including the sealing rings 17 and 19 here shown is heated to the melting temperature of the solder and the parts are bonded together. The medium to be cooled, oil for example, flows through the bore 15 into the mounting plate 14 and distribution plate 13 and then into the heat exchanger where it is distributed to the individual levels indicated by the arrows 16 and leaves the heat exchanger through the bore 18.

The distribution plate 13 is shown in a plan view in FIG. 2. In it a bore 15 is provided for the oil to enter and an opening 20 in the form of a slot for the oil return. Furthermore, the opening 21 is provided in the distribution plate 13 for the entry of the coolant water, and the opening 22 for the discharge of the coolant water. It can be seen from this representation that both the bores for the entry of the oil to be cooled and the passages for carrying it further can be placed at any desired positions. The distribution plate permits the heat exchanger to be connected to any kind of connection. Of course it is also possible to configure the distribution plate with offsets, recesses or the like and thus adapt it to a great number of different mounting structures.

FIG. 3 shows a variant of the heat exchanger with a distribution plate 13 which is arranged in sandwich form. This distribution plate 13 consists of the individual parts 23, 24 and 25. Due to the sandwich-like configuration the possibility exists of distributing the fluid streams differently into the individual levels, so that they can also cross over one another.

In FIG. 3, furthermore, the connections are shown for the coolant, that is, the cooling water. The connections 27 for the water inlet and connections 28 for the water return are disposed on the housing 30. The housing 30 is joined to the mounting plate 14. Between the mounting plate and housing there is a molded gasket 29.

A variant in which a sandwiched adapter plate is also provided is shown in FIG. 4. In this figure the water outlet 22 and the oil inlet can be seen. All the openings are integrated in a housing 30 of an oil filter not represented here, so that no additional lines are necessary.

FIG. 5 shows a variant in which both the water outlet and the water inlet are each drawn out as connections 32 and 33 and bent around by 90° and more than 90°, respectively. The connections are soldered to the distribution plate in a preferred manner, while the oil, as shown in FIG. 4, enters and leaves through a housing 30. Here too a groove 31 is cast between the mounting plate and the housing and a ring or sealing means is laid in it for sealing purposes. On account of this seal no machining of the cast part 30 is necessary. Thus a tight joint is produced between the oil cooler and the external structure of a housing, with low production cost.

In FIG. 6 is shown the fluid stream in the individual plate elements 23–25, which are sandwiched together.

FIG. 6*a* shows the base plate 14 with the oil inlet 15 and the oil outlet 20 which is offset at an angle thereto, as well as the water inlet 21 and the water outlet 22. The plate element 25 is shown in FIG. 6*b*, wherein a slot 34 is disposed for the water inlet. In FIG. 6*c* the plate element 24 is represented. It is configured as a shut-off plate element. FIG. 6*d* shows a cross connection 35 for the water outlet 21 as well as a cross connection 36 for the oil outlet 20. In FIG. 6*e* the first trough 11*a* is shown, with its connection openings for water inlet and outlet, and for oil inlet and outlet.

I claim:

1. A heat exchanger, especially an oil cooler for internal combustion engines, comprising a plurality of tubes arranged parallel to one another for carrying the heat exchange medium, and heat exchanger elements in plate form disposed in a laminar manner and perpendicular to the tubes, which are affixed to the tubes, the plate-like heat exchanger elements being rounded at outside edges and lying flake-like one on the other, the medium to be cooled being fed through additional tubes disposed perpendicular to the heat exchange elements, and which lead into a distribution plate which is formed as a sandwich-like assembly of flat individual plate elements and has a fluid inlet and a fluid outlet, wherein the inlet and/or outlet for the coolant is provided in the distribution plate.

2. A heat exchanger according to claim 1, wherein a mounting plate is disposed on the distribution plate.

3. A heat exchanger according to claim 1, wherein the heat exchange elements and/or the distribution plate as well as pipe nipples disposed in the heat exchange elements are comprised of aluminum.

4. A heat exchanger according to claim 1, wherein the individual elements are soldered and bonded to one another.

5. A heat exchanger according to claim 1, wherein connections for the inlet and outlet of the medium to be cooled as well as the heat exchange medium or coolant are integrated in housing of an oil filter.

6. A heat exchanger according to claim 1, wherein connections for the coolant are disposed directly on the distribution plate.

* * * * *